United States Patent [19]

Day

[11] 4,229,039

[45] Oct. 21, 1980

[54] INSERT TRAVEL CHAIR AND METHOD OF TRANSPORTING THE HANDICAPPED

[76] Inventor: Frederick L. Day, Rte. 2, Box 78, Ladson, S.C. 29456

[21] Appl. No.: 941,253

[22] Filed: Sep. 11, 1978

Related U.S. Application Data

[63] Continuation-in-part of Ser. No. 800,434, May 25, 1977, Pat. No. 4,113,307, and a continuation-in-part of Ser. No. 680,766, Apr. 27, 1976, abandoned.

[51] Int. Cl.[2] ..... A47K 11/02; A47C 15/00; A47C 4/52

[52] U.S. Cl. ..... 297/232; 4/480; 280/650; 297/16; 297/183; 297/400; 297/437; 297/DIG. 4

[58] Field of Search ..... 5/81, 82 R; 108/133; 280/47.37 R, 47.37 L, 47.37 C, 47.4, 47.25, 650; 297/183, 363, 364, 397, DIG. 4, 399–402, 16, 34, 51, 52; 4/134

[56] References Cited

U.S. PATENT DOCUMENTS

| | | | |
|---|---|---|---|
| 1,691,620 | 11/1928 | Wilson | 4/134 |
| 2,601,889 | 7/1952 | Everest et al. | 297/DIG. 4 |
| 2,670,785 | 3/1954 | Machet | 297/364 |
| 3,764,180 | 10/1973 | Mulholland | 297/400 |
| 3,857,343 | 12/1974 | Greenberg | 108/133 |
| 3,889,963 | 6/1975 | Brattgard | 297/DIG. 4 |
| 4,052,087 | 10/1977 | Gagliardi | 280/650 |

FOREIGN PATENT DOCUMENTS

| | | | |
|---|---|---|---|
| 1425235 | 12/1965 | France | 297/16 |
| 679145 | 12/1964 | Italy | 297/DIG. 4 |
| 880773 | 10/1961 | United Kingdom | 297/183 |

*Primary Examiner*—James C. Mitchell

*Attorney, Agent, or Firm*—Schwartz, Jeffery, Schwaab, Mack, Blumenthal & Koch

[57] ABSTRACT

A travel chair includes a back pivotable both forwardly and rearwardly and pivotable underneath the chair to form a generally triangular arrangement for ease in carrying and further includes detachable wheels for use of the chair in automobiles and the like. The chair further includes a pair of spring means for biasing the rear legs in a rearward direction and means for removably securing and adjusting the footrests, as well as spring-biasing means for urging the rear handles in a locked position. Finally, front handles are pivotable in vertical and horizontal directions, and a head restraint is provided.

28 Claims, 13 Drawing Figures

INSERT TRAVEL CHAIR AND METHOD OF TRANSPORTING THE HANDICAPPED

CROSS-REFERENCE

This is a continuation-in-part of my previously filed Application Ser. No. 800,434, filed May 25, 1977 and now U.S. Pat. No. 4,113,307, issued Sept. 12, 1978, which in turn was a continuation-in-part of my previously filed Application Ser. No. 680,766, filed Apr. 27, 1976.

BACKGROUND OF THE INVENTION

1. Field of the Invention

The invention relates generally to means for permitting a wheelchair confined person ease in transportation, and more particularly, to an insert travel chair with certain improvements over and above my previously filed Application Ser. No. 800,434, filed May 25, 1977, now U.S. Pat. No. 4,113,307, issued Sept. 12, 1978 which is hereby incorporated by reference. My previous patent application and the instant application are directed to an insert travel chair which may be placed within a conventional chair or conveyance and public facility seat.

2. Prior Art

The prior art has been discussed in my previously filed patent application. In addition, reference is made to the prior art cited by the Examiner in the previous application.

OBJECTS AND SUMMARY OF THE INVENTION

The instant application has as its objects those recited in my previously filed application, together with certain additional features which will be appreciated from the description below. Specifically, the instant application is directed toward the following:

(1) The ability to fold the insert travel chair for ease in transporting and storing.

(2) The adaption of a head restraint.

(3) The provision of spring-biasing means for urging the rear legs of the chair in a generally ground engaging direction.

(4) The provision of means for easily removing the wheels of the chair.

(5) The ability to pivot the front handles in a vertical and/or horizontal direction.

(6) The ability to easily remove and adjust the footrests.

(7) The provision of spring-biasing means for positioning the rear handles.

The above objects are accomplished by providing the travel chair of my previous application with a back pivotable both forwardly and rearwardly and pivotable underneath the chair to form a generally triangular arrangement for ease in carrying and further providing detachable wheels for use of the chair in automobiles and the like. The chair further includes a pair of spring means for biasing the rear legs in a rearward direction and means for removably securing and adjusting the footrests, as well as spring-biasing means for urging the rear handles in a locked position. Finally, front handles are pivotable in a vertical direction and a head restraint is provided.

BRIEF DESCRIPTION OF THE DRAWINGS

The above and other objects of the invention and advantages thereof will be understood from the following description when read in conjunction with the accompanying drawings wherein.

DETAILED DESCRIPTION OF THE INVENTION

Figure 1:
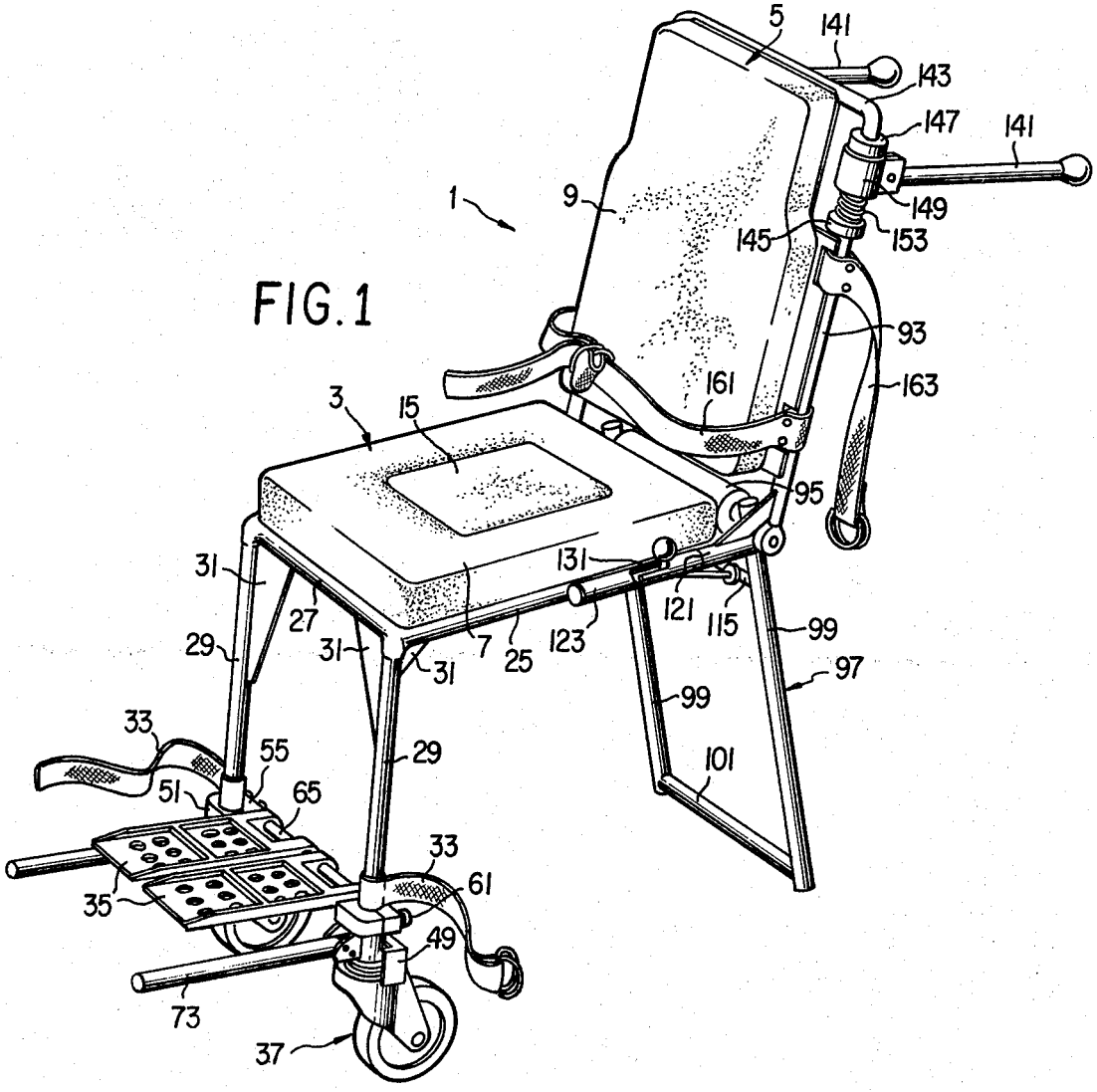
FIG. 1 is a perspective view of the insert travel chair of the instant invention.
Figure 2:
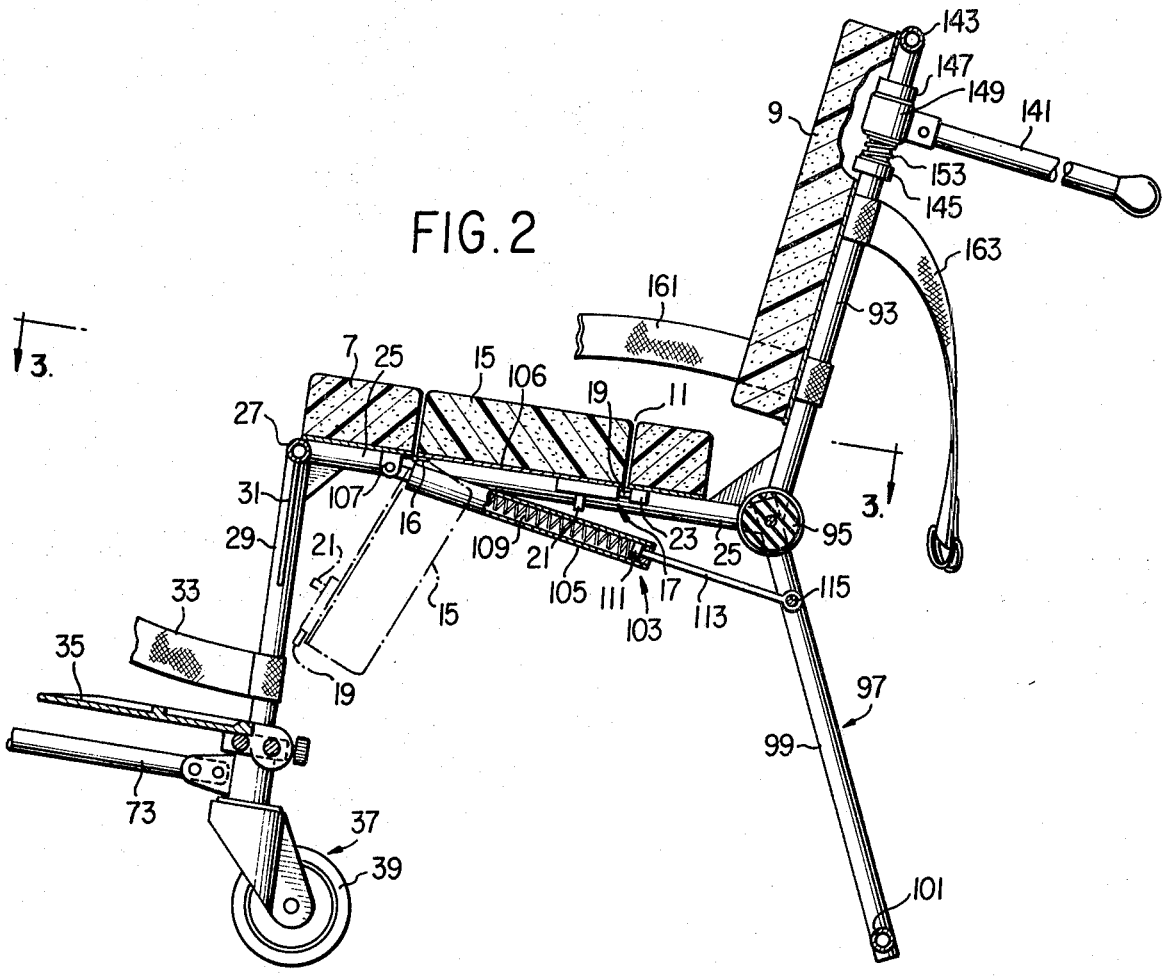
FIG. 2 is a side elevation view of the chair of FIG. 1 seen partially in cross-section.
Figure 3:
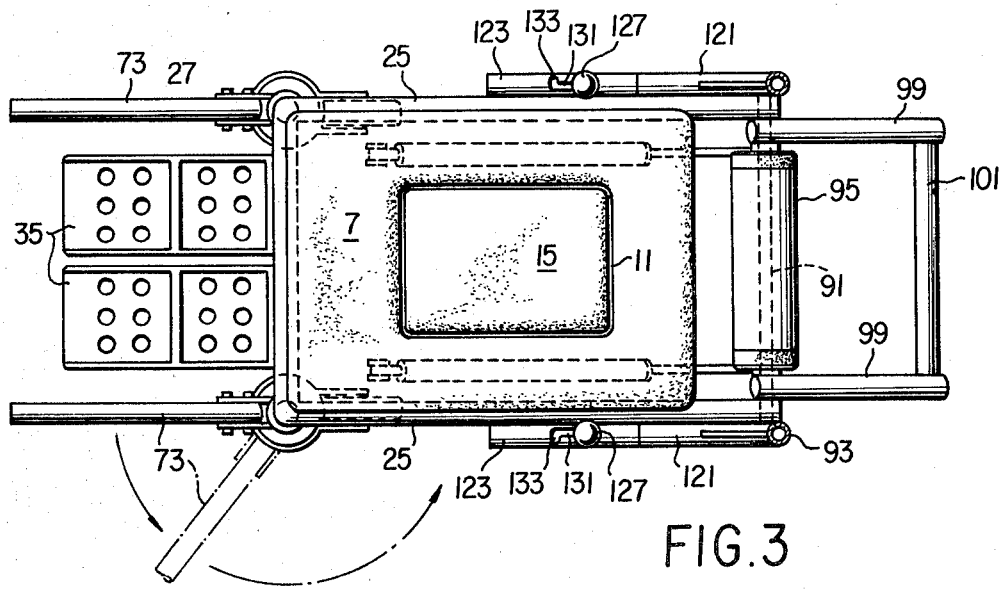
FIG. 3 is a top section view of the chair taken along lines 3—3 in FIG. 2.

Referring now to FIGS. 1–3, an insert chair 1 is seen positioned in a ground engaging position and having a seat portion generally at 3 and a pivoted back portion seen generally at 5.

A seat 7 and a back 9, both made of conventional cushioned material, are positioned onto a frame of the chair 1 and will be discussed in detail below.

The seat cushion 7 as seen in FIGS. 1–3 includes an opening 11 therein. A seat insert 15 is positioned within the opening 11 and pivots about a hinge 16 located toward the front of the seat. Attached to the insert 15 is a lock mechanism 17 which includes a sliding member 19 having a handle 21 engaging a member 23 (FIG. 2) in a conventional manner. Thus, the lock 17 will hold the insert in the closed position; however, it may be moved downwardly about the hinge 16 so that the unit may be positioned over a toilet without having the occupant transferred out of the unit onto the toilet. It will be appreciated that the insert 15, swinging toward the front will permit the chair to slide over the toilet from front to rear with the seat out of the way of the toilet as seen in dotted form in FIG. 2.

The seat cushion 7 is positioned on a pair of forwardly extending seat frame members 25 which are joined together at the front end by a transverse member 27. A pair of downwardly extending members 29 are connected to frames 25 and 27 and reinforced by gussets 31. A pair of straps 33 are seen secured to the downwardly extending members 29. These perform the function of holding an individual's legs in place, and also will hold a pair of leg rests 35 (discussed in greater detail below) in a substantially vertical position.

Figure 7:
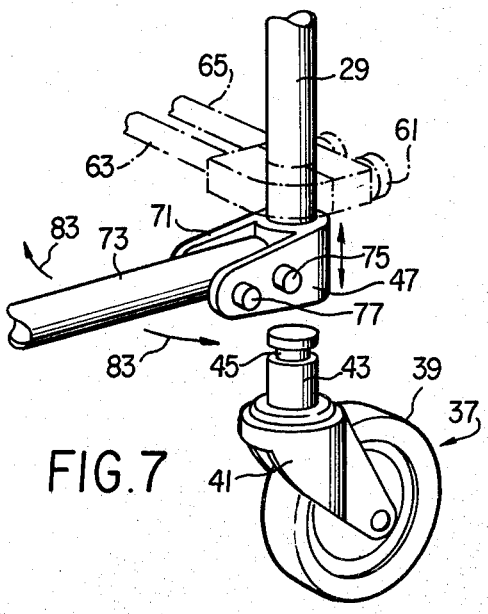
FIG. 7 is an exploded perspective view of a detachable wheel for use with the chair.

Also attached to members 29 are a pair of caster wheels 37 which are removable as seen in FIG. 7. The caster wheels include a wheel 39 rotatably positioned in a yoke 41 having an upstanding member 43 thereon. Member 43 includes a grooved portion 45 adapted to engage a conventional vertically slidable lock sleeve member or a conventional snap-in member 47 having spring-biased ball bearings or other locking means therein which will be biased into groove 45 whereby the caster wheel can be pushed into a cylindrical opening in member 47 and locked in place in a substantially conventional manner and can be removed by exerting a pulling force on the caster wheels 37. On one of the pair of members 47 is a downwardly extending locking element 49 (see FIG. 1) which limits the rotation of one wheel so that the chair can easily be pushed in a straight line without sideward movement, yet is able to be turned and go into an aisle between two rows of seats.

Figure 4:
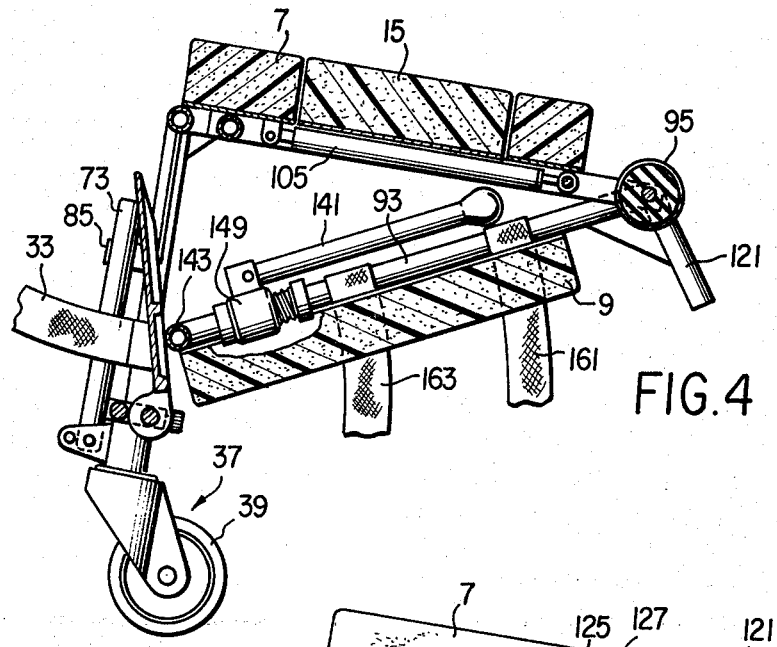
FIG. 4 is a view partially in cross-section of the chair in its folded position.
Figure 5:
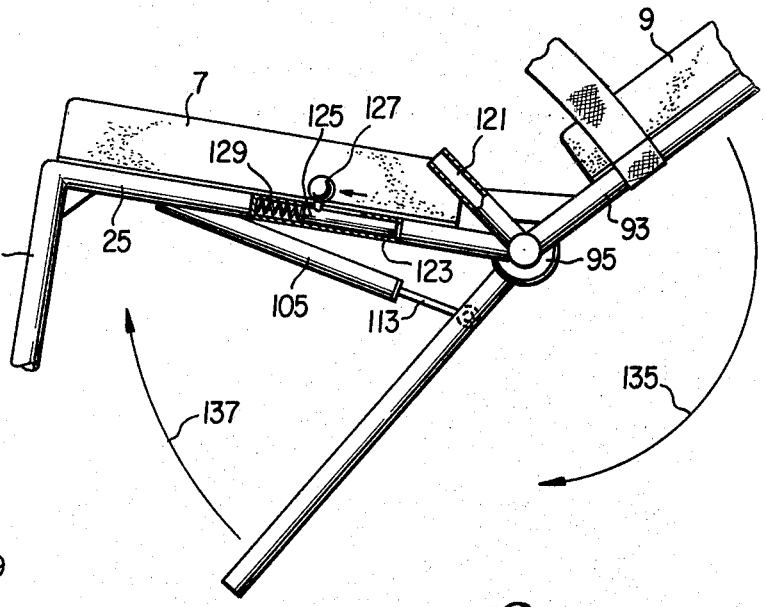
FIG. 5 is a segmental view, partly in cross-section of the chair illustrating the folding feature.
Figure 11:
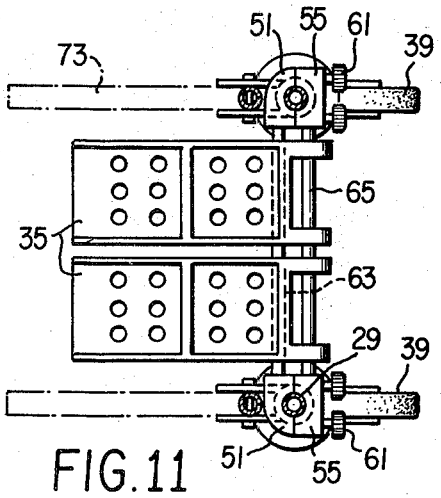
FIG. 11 is a top section view of the footrests taken along lines 11—11 in FIG. 9.
Figure 10:
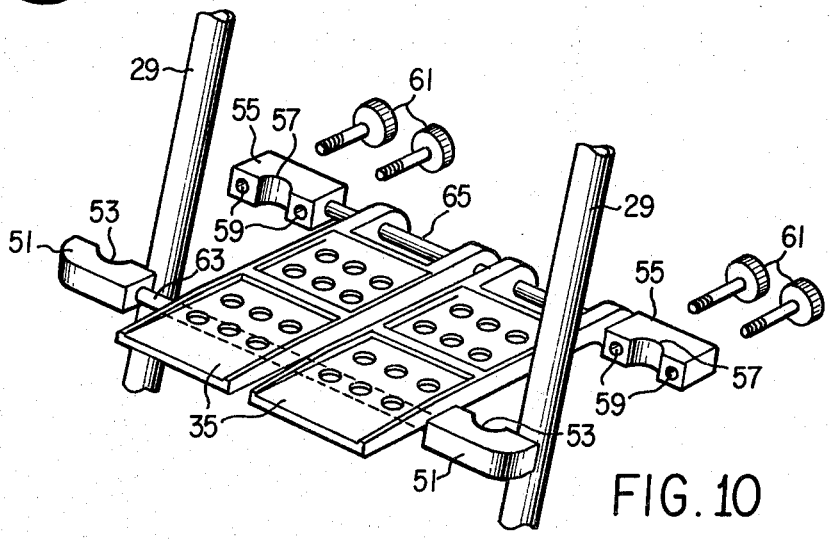
FIG. 10 is an exploded perspective view of the removable footrests.

The pair of footrests 35 are attached to downwardly extending members 29 as seen in FIGS. 10 and 11 by means of a bracket which comprises a pair of front members 51 having a pair of semi-cylindrical grooves 53 therein conforming to downwardly extending cylindrical members 29, as well as a pair of complementary rear members 55 having a pair of complementary semi-cylindrical grooves 57 therein. The front and rear members have aligned openings 59 therein, the front members 51 having threaded portions in their complementary openings. A plurality of thumbscrews 61 are inserted through openings 59 in the rear members 55 and screwed into complementary threaded openings and members 51. In this manner the leg rests can be easily removed or adjusted vertically along members 29. Front members 51 are joined by a rod 63; whereas, rear members 55 are joined by a rod 65 which in turn forms the pivot for the footrests 35. The rod 63 further acts as a stop limiting the distance the footrests 35 can extend downwardly. When the chair is inserted into a conventional seat or folded as seen in FIGS. 4 and 5, the footrests may be pivoted upwardly.

Figure 8:
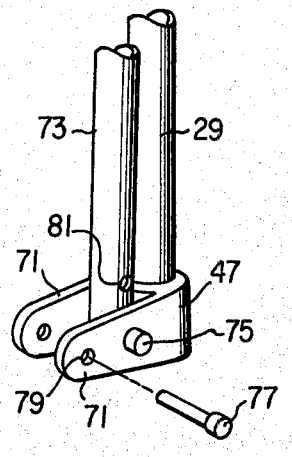
FIG. 8 is a detailed perspective view of one front handle used with the chair illustrated in FIG. 1.
Figure 9:
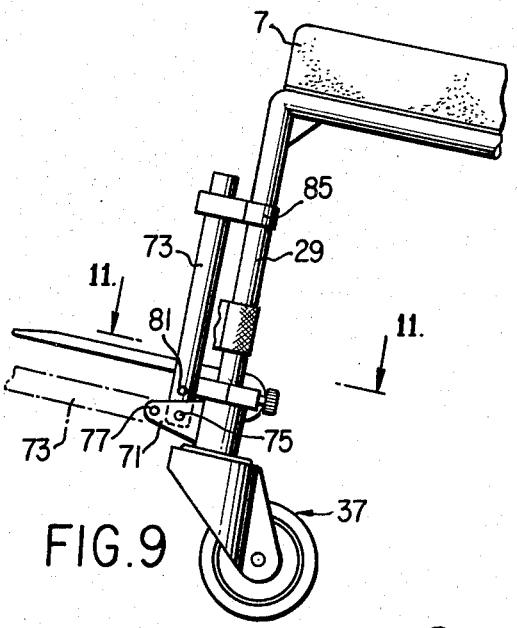
FIG. 9 is a fragmentary side view of the front handle shown in FIG. 8 in its upward locked position and in phantom in its extended position.

Forming a part of bracket 47 are a pair of forwardly extending yokes 71 (FIGS. 7–9) to support a pair of front handles 73. The yokes have a pair of holes into which a pivot pin 75 is inserted through a complementary opening in handles 73. A second pin 77 is inserted through a front opening 79 as seen in FIG. 8 and cooperates with a hole 81 in handle 73 to retain the handles in a forward direction as seen, for example, in FIGS. 1–3 and 7.

It will also be appreciated that the handles 73 can rotate as seen by arrows 83 in FIG. 7 by journaling bracket 47 on downwardly extending members 29. These pivoting and/or rotating handles are used in cooperation with other handles on the back of the chair to be discussed below for lifting the individual while in the chair. It will also be appreciated that the handles 73 may be stored in a vertical position as seen in FIG. 8 and further as seen secured to a clip 85 in FIG. 9, or alternatively can be rotated in a longitudinal plane and stored between downwardly extending members 29 as is done in my previous patent application.

A transverse bar or rod 91 extends between parallel members 25 and includes a pair of upstanding back support members 93 pivoted thereon. Further, a roller 95 also rotates on rod 91. A rear leg means 97 comprising a pair of downwardly extending members 99 joined by a lower bight member 101 is also pivoted on the rod 91. As seen in FIG. 2 the rear leg 97 is biased by a pair of members 103 including a cylinder 105 pivoted to a seat cushion support 106 on a pair of brackets 107 and having a spring-biasing member 109 therein. Connected in the cylinder and abutting the spring 109 is a member 111 attached to a piston rod 113 which in turn pivots on a cross piece 115 on the rear leg 97. By pushing rear leg 97 against the spring-biased force of spring 109, the rear leg can be positioned underneath and substantially parallel with the seat member as the unit is slid over a conventional seat.

As seen in FIGS. 4 and 5, and further discussed below, the entire unit can be collapsed into a triangle. The various pivotal connections on rod 91 can be accomplished by means of brackets attached to members pivoted thereon. Obviously, bushings can be inserted in each bracket to facilitate the pivoting action.

As seen in FIGS. 1 and 3, a bolt lock mechanism is seen comprising a pair of first tubular members 121 attached to rear frames 93 and a pair of front members 123 secured to frame members 25. As will be more clearly seen in FIG. 5, a bolt 125 having a handle 127 is spring-biased by a spring 129 into the opening in tube member 121. A slot 131 provides means for the bolt to slide forward and rearwardly. The slot 131 is substantially L-shaped and includes a shorter leg 133 for facilitating locking the bolt in the forward position. When the bolt is in the forward position, the back may pivot as seen in FIG. 5. The pivoting back is utilized for several purposes. First of all, it conforms with the back of a seat which may be reclined and on aircraft. Further, it is always opened so that the seat may also pivot forwardly with the seat back in case of a crash. Secondly, the bolt will be in the position seen in FIG. 5 permitting the back to be pivoted as illustrated by arrows 135 and 137 so that the unit may collapse into a triangle seen in FIG. 4 for ease in carrying and storage.

Figure 12:
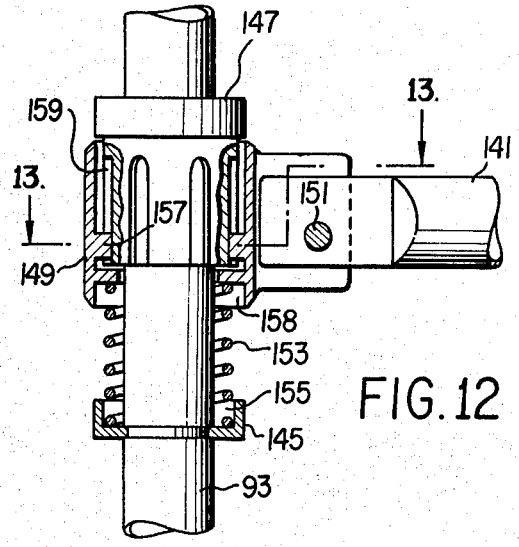
FIG. 12 is a detailed view partially in section of the rear handle.
Figure 13:
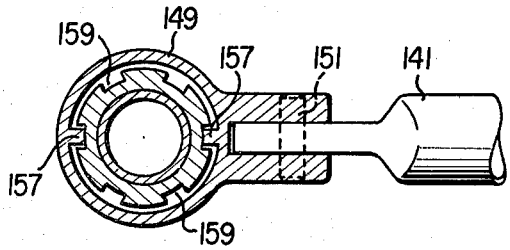
FIG. 13 is a cross-sectional view taken along lines 13—13 in FIG. 12.

Reference is now made particularly to FIGS. 12 and 13 wherein a pair of swinging and pivotable handles 141 are secured to the back frame elements 93, elements 93 being joined by a top cross-piece member 143 (FIG. 1). Each frame element 93 has a lower collar 145 and an upper collar 147 non-rotatably secured thereto. Between the collars is positioned a rotating sleeve 149 to which is pivotally secured at 151 the rear handles 141. A spring 153 surrounds the members 93 and is positioned in a lower cup 155 of the lower collar 145 and in an upper cup 157 in rotating sleeve 149. Rotating sleeve 149 also has a pair of spline members 157 which cooperate with a plurality of detents or slots 159 which depend from the upper collar 147. The handles are locked in the position seen in FIGS. 12 and 13. However, in order to rotate the handles to another position, other than rearwardly extending, it is necessary to push down on handles 141 and sleeve 149 so that the splines 157 clear the bottom of the slots 159. The handles then can be rotated to a front position where they may be either used to push the chair rearwardly if the handles are extended or can be pivoted downwardly to rest alongside the back cushion 9 and out of the way. The handles may also be rotated to various positions in accordance with the number and location of slots 159.

A lower torso seat belt is seen at 161 and an upper torso seat belt is shown at 163.

Figure 6:
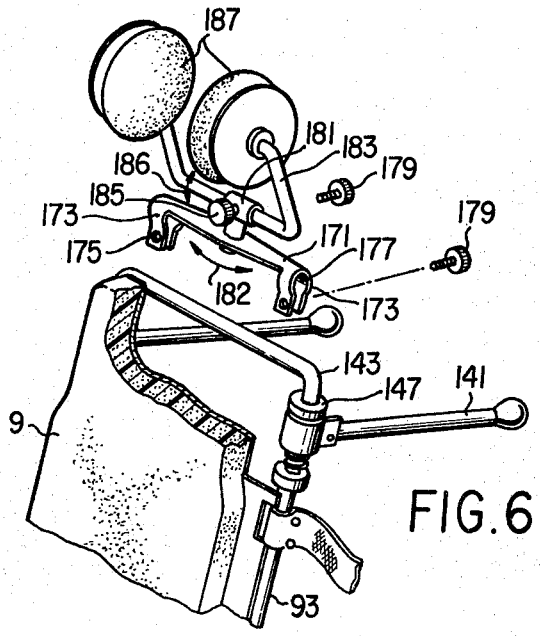
FIG. 6 is a perspective view of a head restraint for the chair illustrated in FIG. 1.

A headrest is incorporated with the unit as seen in the exploded view on FIG. 6. The headrest includes a generally U-shaped member 171 having a pair of complementary downwardly extending U-shaped portions 173 with aligned holes 175 therein. The downwardly extending U-shaped members 173 are rounded at 177 to conform to the upper cross piece 143. A pair of thumbscrews 179 may be inserted into the openings 175 and can either be threaded therein or can have nuts on their ends to hold them in place. Frame 171 has a T-shaped member 181 pivotally mounted thereon around arrow 182. Another U-shaped member 183 is positioned within a transverse opening in member 181. A thumbscrew 185 is used to permit the rotating adjustment of U-shaped element 183 around arrow 186. Positioned on element 183 are a pair of head engaging padded members 187 which may be mounted by ball and socket means to element 183 so that they can better conform to the head of the individual in the chair. Obviously, various modifications of the head restraint element can be provided.

A typical operation or utilization of the device will be seen from the description set out below.

If one assumes that an individual is arriving by car at an airport, train station, bus station, theater, school or the like, the unit may be positioned in the car or bus with the wheels 37 thereon. However, if the car has a low seat, the wheels 37 may be removed. The person arriving at his destination is seated in the insert travel chair substantially as seen in FIG. 1. The rear legs 97 are normally in the ground-engaging position, and the footrests are also seen as in FIG. 1. It has been found that the rear leg means should remain in what may be referred to as the ground-engaging position while pushing the individual therein. In this way, if it is necessary to stop for some reason, the legs readily engage the ground. The unit is moved with the person therein by slightly lifting on the handles 141 and pivoting them on wheels 37; the rear legs are thus raised slightly off of the ground. The handles 141 will have been raised to the position seen in the various figures of the drawings, and the splines will be in engagement with the slots or teeth by means of the springs 153, thus assuring that the handles will not rotate. The individual can be moved by one person to a seat, or alternatively, since the chair is between 12 and 16 inches in width, it can be inserted into another wheelchair, and the individual can propel himself around in a facility.

When the unit is placed in the chair, the arms 141 will be rotated around to the front and dropped downwardly so as not to cause an obstruction.

When it is desired to have the individual board an airplane, bus or go upstairs, the individual is rolled to the particular point, and the front handles 73 may then also be extended. One person takes handles 141 and the other person takes handles 73, and together they lift the person up a flight of stairs or the like. When the unit has reached the level of the seats, be it auditorium, plane or bus, the unit can then be pushed down the aisle to the assigned seat. Because of the width of the unit and particularly because of the pivoting wheels 37, it is possible to roll the unit into the seat aisle either sideways or straight in and then pivot the unit. It will be appreciated that the handles 141 can be rotated to any position to assist in the manipulation of the individual. For example, when the roller 95 is placed against the edge of the seat, the handles 141 can either be used to pull the person into the seat or rotated to the front, and push the person and chair back onto the seat.

If it is necessary for the individual to use a lavatory, the same procedure can be used with the aid of the rotating handles 141 so as to manipulate the individual onto the toilet with the seat insert 15 in the open position seen in dotted lines in FIG. 2. The roller 95 is placed on the edge of the toilet seat, and the unit is pushed rearwardly with the handles 141 in the forward position. Again, because the width of the unit is normally only between 12 and 16 inches and the depth is no more than an ordinary seat, it is possible for an attendant to move around the unit.

Discussion has been made above with regard to storing of the back handles 141, but, as was discussed above, it is possible to store the front handles 171 either vertically or horizontally.

While the invention has been described, it will be understood that it is capable of further modifications and this application is intended to cover any modifications, uses or adaptations of the invention following in general the principles of the invention and including such departures from the present disclosure as come within known or customary practice in the art to which the invention pertains, and as may be applied to the essential features hereinbefore set forth and as fall within the scope of the invention or limits of the appended claims.

What is claimed is:

1. A foldable insert travel chair comprising:

(a) a seat having a front and rear, (b) a back pivotally attached to the rear of said seat, said back being pivotable forwardly from an upright position and rearwardly to a collapsed position relative to said seat, wherein said back is positioned substantially under said seat, (c) means for latching said back in a position wherein said back may be locked in the upright, non-pivoting position and unlocked into the pivotable position, (d) wheel means connected to the chair, (e) the area under the rear of said seat being substantially unobstructed whereby said seat may be positioned over a conventional seat, (f) leg means extending downwardly from and pivotally connected to the rear of said seat, said leg means being movable from a ground engaging position to a position substantially under said seat, (g) handle means extending from said back for moving the chair from place to place.

2. A foldable insert travel chair as defined in claim 1 wherein said back handle means include a pair of back handles, and (a) said pair of back handles are adjustably positioned on said back, means for pivoting said back handles from a substantially vertical position to a substantially horizontal position, (b) a pair of front handles pivotally connected to the front of the chair movable from a position substantially parallel to the front of the chair to a position substantially perpendicular to the front of the chair.

3. A foldable insert travel chair as defined in claim 2 including means for pivoting and locking said back handles from a position extending rearwardly of said back to a locked position wherein said back handles extend in a substantially horizontal plane and forwardly of said back.

4. A foldable insert travel chair as defined in claim 1 including a pair of footrests pivotally and adjustably connected to the front of said chair.

5. A foldable insert travel chair as defined in claim 1 including means for biasing said leg means into a ground engaging position.

6. A foldable insert travel chair as defined in claim 1 wherein said latching means includes:
(a) a tubular member connected to said back,
(b) a tubular member connected to said seat,
(c) a bolt movable from a position engaging said tubular members to a position disengaging one of said tubular members.

7. A foldable insert travel chair as defined in claim 1 including roller means positioned at the point where said back and seat are pivotally attached to each other.

8. A foldable insert travel chair as defined in claim 7 including a rod through said roller attached to said seat and wherein said back and said leg means pivot on said rod.

9. A foldable insert travel chair as defined in claim 1 including a headrest attached to said back, said headrest being adjustable.

10. A foldable insert travel chair as defined in claim 1 wherein said wheel means includes a pair of wheels removably secured to said chair.

11. A foldable insert travel chair as defined in claim 1 including a pair of front handles pivotally connected to the front of the chair movable to a position substantially parallel to the front of the chair.

12. A foldable insert travel chair as defined in claim 11 wherein said front handles are pivotable in a horizontal plane.

13. A foldable insert travel chair as defined in claim 11 wherein said front handles are movable in a vertical plane.

14. A foldable insert travel chair as defined in claim 11 wherein said front handles are movable in a horizontal plane and a vertical plane.

15. A foldable insert travel chair as defined in claim 1 including an insert pivotally positioned in said seat.

16. A wheelchair comprising:
(a) a seat,
(b) a back having a front and a rear connected to said seat,
(c) wheels connected to said seat,
(d) a pair of back handles connected to said back, said handles including:
(1) means for pivoting said handles from a substantially vertical position to a substantially horizontal position,
(2) means for rotating and locking said handles in a position extending toward the rear of said back and in a position extending forwardly of the back.

17. A wheelchair as defined in claim 16 including means for locking said back handles in at least one additional position.

18. A wheelchair as defined in claim 17 wherein said locking means includes a spline member and a detent member, one of said members positioned on said handles and the other of said members on said back.

19. A wheelchair as defined in claim 18 including means for biasing said members in engagement with each other.

20. A method of transporting the physically handicapped to and/or from a conventional seat comprising:
(a) providing a chair with a seat, attaching front wheels thereon, the seat being substantially free of obstructions under the rear thereof,
(b) providing the chair with a back,
(c) positioning leg means under the rear of the seat in a ground engaging position to form a self-supporting chair, including biasing the leg means in the ground engaging position,
(d) positioning a physically handicapped person in the chair,
(e) pivotally connecting a pair of back handles on said back,
(f) pivoting said back handles to a substantially horizontal position to extent rearwardly of said back, rotating and locking said back handles in a position extending toward the rear of said back and in a position extending forwardly of said back,
(g) transporting the person in the chair by rolling the chair on said wheels, at least one of said front wheels being permitted to pivot whereby the conventional seat may be approached from a variety of angles,
(h) nesting the chair onto a conventional seat and sliding the rear of the chair seat over the conventional seat,
(i) pivotally connecting a pair of front handles on said front adjacent said front wheels.

21. The method of claim 20 including:
(a) pivotally connecting the back to the seat,
(b) latching the back relative to the seat while transporting the person,
(c) unlatching the back relative to the seat and pivoting the back.

22. The method of claim 21 including pivoting the back relative to the seat whereby the chair is folded into a substantially triangular shape.

23. The method of claim 20 including removably securing the wheels to the chair.

24. The method of claim 20 including positioning a detachable headrest on the back of the chair.

25. The method of claim 20 including pivoting said front handles from a position substantially parallel to the front of the chair to a position substantially perpendicular thereto.

26. The method of claim 20 providing footrest means on the front of the chair and adjustably positioning said footrest means vertically to conform to the location of the occupant's feet.

27. The method of positioning a physically handicapped person on a toilet comprising:
(a) providing a chair with a seat,
(b) attaching wheels to the chair,
(c) positioning leg means under the rear of the seat, said leg means being movable from a ground engaging position to a position wherein the seat is substantially free of obstructions under the rear thereof,
(d) providing the seat with an insert pivotally connected on the forward side thereof,
(e) pivoting the insert downwardly from a position substantially coextensive with the seat to a position substantially greater than 90° relative to its substantially coextensive position,
(f) positioning the seat over the toilet wherein the opening formed by the pivoting of the insert is over the toilet, the insert being pivoted by action of the toilet against the insert.

28. A foldable insert travel chair as defined in claim 1 wherein said back handle means includes a pair of back handles, means for rotating and locking said back handles in a position extending generally rearwardly of said back and generally forwardly of said back.

* * * * *